United States Patent [19]

Love

[11] 4,314,508

[45] Feb. 9, 1982

[54] DEVICE WITH INCENDIARY FUSECORD IGNITED BY DETONATION

[75] Inventor: Thomas L. Love, Deer Park, Australia

[73] Assignee: ICI Australia Limited, Victoria, Australia

[21] Appl. No.: 14,248

[22] Filed: Feb. 22, 1979

[30] Foreign Application Priority Data

Mar. 17, 1978 [AU] Australia ..... PD3747

[51] Int. Cl.[3] ..... C06C 5/04

[52] U.S. Cl. ..... 102/275.7; 102/275.3

[58] Field of Search ..... 102/27 R, 27 F, 275.3, 102/275.7

[56] References Cited

U.S. PATENT DOCUMENTS

| | | | |
|---|---|---|---|
| 927,968 | 7/1909 | Harle | 102/27 F |
| 932,701 | 8/1909 | Harle | 102/27 F |
| 3,572,246 | 3/1971 | Hare et al. | 102/27 R |
| 3,587,466 | 6/1971 | Prior | 102/27 R |
| 3,590,739 | 7/1971 | Persson | 102/27 R |
| 3,734,019 | 5/1973 | Rentz et al. | 102/27 R |
| 4,041,867 | 8/1977 | Enoksson | 102/27 F |
| 4,112,845 | 9/1978 | Savitt | 102/27 R |
| 4,165,691 | 8/1979 | Bowman et al. | 102/27 R |
| 4,187,780 | 2/1980 | Petruccelli | 102/27 R X |

*Primary Examiner*—Peter A. Nelson

*Attorney, Agent, or Firm*—Cushman, Darby & Cushman

[57] ABSTRACT

A fuse device comprising incendiary fusecord and a means of igniting same by detonation.

11 Claims, 11 Drawing Figures

Figure 8:
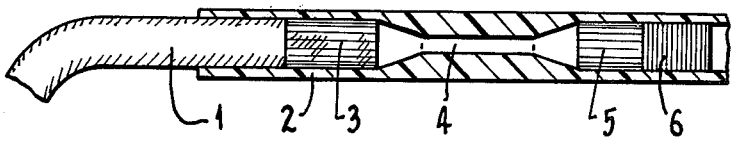

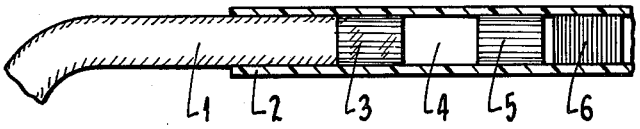
FIG. 1.
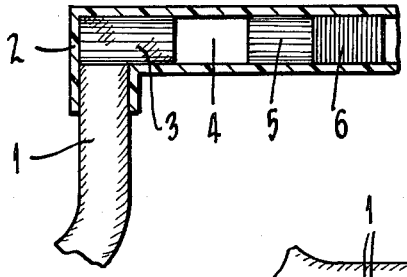
FIG. 2.
FIG. 3.
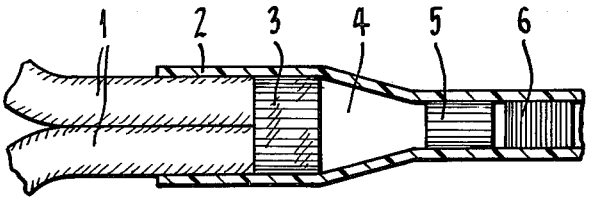
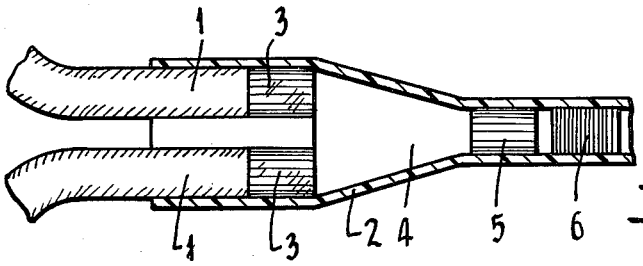
FIG. 4.
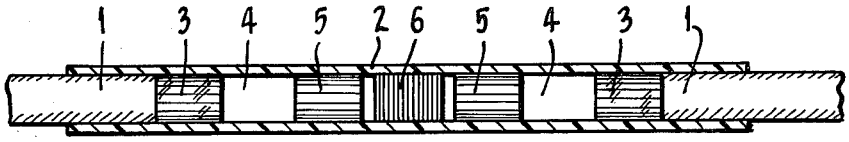
FIG. 5.
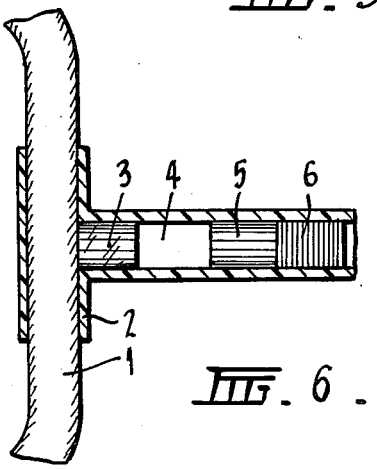
FIG. 6.
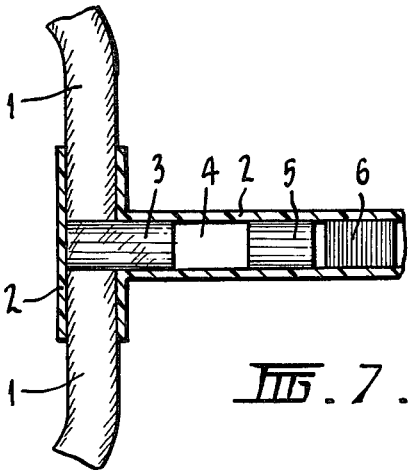
FIG. 7.

DEVICE WITH INCENDIARY FUSECORD IGNITED BY DETONATION

This invention relates to fuse devices comprising incendiary fusecord of the kind commonly employed for the transmission of energy and flame in blasting operations.

Such fusecord usually comprises a core of incendiary material surrounded by non-explosive wrapping materials, for example, textile yarns and/or synthetic plastics materials. Such incendiary fusecord is exemplified by commodities known in the art as safety fuse, slow igniter cord and fast igniter cord.

Safety fuse has a core which burns at a relatively slow rate (about 100 seconds/meter) and which usually comprises the well known black powder which is a mixture of charcoal, sodium or potassium nitrate and sulphur. The core is often encased in a thin envelope of paper or plastics film. Reinforcing yarns which may typically be derived from cellulose, glass, paper or synthetic polymers are applied around the envelope and a water-proof sheath of bituminous or thermoplastics material is applied over the yarns.

Slow igniter cord which burns at a rate of about 33 seconds/meter comprises a plastic incendiary composition extruded around central copper and/or iron wires and all is covered with a thin extruded plastic sheath.

Fast igniter cord which burns at a rate of about 3.3 seconds/meter comprises a core of extruded incendiary composition contained in a cotton covering over which is applied an extruded layer of plastic incendiary material and an outer plastic covering.

Incendiary fusecord may be ignited in many ways. Striking a match box across the head of a match held in contact with the exposed powder core is a common practice. Other methods include the use of a hot iron, glowing stick, or an acetylene lamp. However to be assured of igniting fusecord, particularly if it is one of several in an array, it is essential to use an incendiary device maintained in contact with the core of the fusecord and which provides a hot flame difficult to extinguish.

It is difficult to ignite incendiary fusecord reliably by means of a detonator because the energy input from the latter is usually not sufficiently prolonged and also the shock wave is so intense that it breaks up the powder core of the fusecord before it is ignited. Even if an incendiary device is interposed between the detonator and the fusecord, ignition is still unreliable because of the dispersing action of the shock wave on the incendiary device.

We have now found a way of constructing a device comprising an incendiary fusecord which provides a means whereby the fusecord may be reliably ignited by a detonation.

Accordingly the present invention provides a fuse device comprising at least one length of incendiary fusecord as hereinafter defined; at least one incendiary igniting means; and at least one incendiary initiating means; said device being characterised in that the said fusecord is located in a tubular container in such a manner that a part of the incendiary core of the said fusecord is in contiguous relationship with an incendiary igniting means which is separated from one of the said incendiary initiating means by a gap.

By incendiary fusecord we mean an energy conveying device comprising an incendiary element along which energy is conveyed by a burning process. Such fusecord is typified, for example, by the well known safety fuse, slow igniter cord and fast igniter cord.

By incendiary igniting means we mean a mass of incendiary material which when it burns provides an intense hot flame capable of igniting the incendiary core of the fusecord. The said incendiary material itself must be capable of being ignited by the incendiary initiating means, which in turn must be capable of being ignited by a detonating device, such as a detonator or detonating cord. It is convenient, but optional, that the compositions of the two incendiary components are similar, for example they may comprise red lead and silicon. Convenient incendiary components are what is known in the art as delay elements, which are typically multi-cored lead tubes with incendiary material in the cores.

The tubular container is essentially a tube with a hollow core along its axis and which is open at both ends. The cross-sectional area of the core may vary along its length. It may be constructed of any suitable solid material, such as plastics or metallic material.

The gap between the incendiary initiating means and the incendiary igniting means is a space which contains a gas, conveniently air, or a vacuum. The shape of the gap is not critical but one preferred shape is that in which the cross-sectional area of the gap in a plane at right angles to the notional line joining the two said incendiary means is not greater than the cross-sectional area of the incendiary initiating means in a plane parallel to the first said plane. In effect the gap or part of it constitutes an orifice between the two said incendiary means. The width of the gap, i.e. the distance between the incendiary igniting means and the incendiary initiating means is not closely critical. It depends on the nature of these means. However the preferred gap width is one in the range of 10 mm to 30 mm inclusive.

The invention is now illustrated by, but, is not limited to, the following embodiments with reference to the accompanying drawings which are merely block diagrams illustrating the disposition of components of the device of the invention relative one to another. FIG. 1 is a sketch, not to scale, of a first embodiment of the invention illustrating the position of a fusecord, incendiary igniting means and incendiary initiating means relative one to another in a device according to the invention and relative to a detonating device. FIGS. 2 to 7 inclusive are each similar to FIG. 1 and each illustrates a further embodiment of the invention.

In FIGS. 1 and 2 the end of a length of fusecord 1 is located in a cylinder 2 so that the incendiary core of the fusecord 1 is in contact with an incendiary igniting means 3 which is separated by a gap 4 from an incendiary initiating means 5.

A typical way of igniting the device of the invention is to detonate a detonator, 6, which is not part of the device of the invention, in close proximity to the incendiary initiating means by any means known to those skilled in the art. This detonation ignites the incendiary initiating means 5 and propels burning particulate debris from it along the container 2 across the gap 4 onto the incendiary igniting means 3 thereby igniting it. The incendiary igniting means 3 burns with an intense hot flame (not shown) which in turn ignites the incendiary fusecord 1.

In another embodiment, FIG. 3, of this invention the incendiary igniting means may be in contact with, and thereby ignite, the cores of two or more lengths of fusecord.

In another embodiment, FIG. 4, the incendiary initiating means may be used to ignite two or more incendiary igniting means.

In another embodiment, FIG. 5, more than one incendiary igniting means may be ignited by separate incendiary initiating means which in turn have been ignited by one or more detonating devices.

In another embodiment, FIG. 6, the length of fusecord is so located that its core extends in two directions from the point at which the said core is in contiguous association with the incendiary igniting means.

In another embodiment, FIG. 7, two lengths of fuse cord are located so that their cores extend in opposite directions from the incendiary igniting means.

In FIGS. 3, 4, 5, 6 and 7 lengths of fusecord are indicated by 1, tubular container by 2, incendiary igniting means by 3, gaps by 4, incendiary initiating means by 5 and detonating devices, which may be detonators or detonating cord, by 6.

Figure 9:
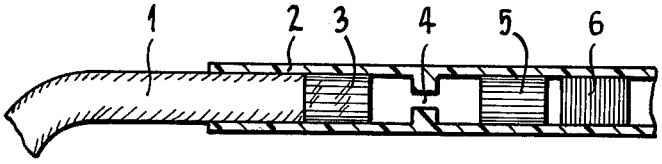

FIGS. 8 and 9, in which the components are numbered in the same manner as in previous figures, illustrate two embodiments of the invention in which the gap 4 forms an orifice.

The length of fusecord may be fixed into the tubular container 2 by use of adhesives or by crimping or any other means known to those skilled in the art.

This invention is of particular advantage in situations where a series of shot holes are to be fired in sequence using safety fuse to initiate explosive in each hole. Because of the slow burning rate of safety fuse which is typically about 100 seconds per meter, sequential firing of a series of shot-holes may be achieved by using various lengths of safety fuse to each shot-hole. This procedure has been practised in the past, the various safety fuse leads to the individual holes being fired by a trunk-line of igniter cord using the well known and so called "bean-hole" connectors. Because this igniter cord has relatively slow burning rate (3.3 seconds/meter) the sequential effect of using varying lengths of safety fuse tends to be obscured. Replacement of the igniter cord by detonating cord (velocity of detonation about 7000 meters/second) would obviate this effect. Moreover this known igniter cord system has physical shortcomings, particularly under wet conditions, However, heretofore, it was not known how to ignite safety fuse reliably from detonating cord. The present invention provides a means of doing this.

The invention is illustrated by the following examples 1 and 3 without being restricted to them.

EXAMPLE 1

Figure 10:
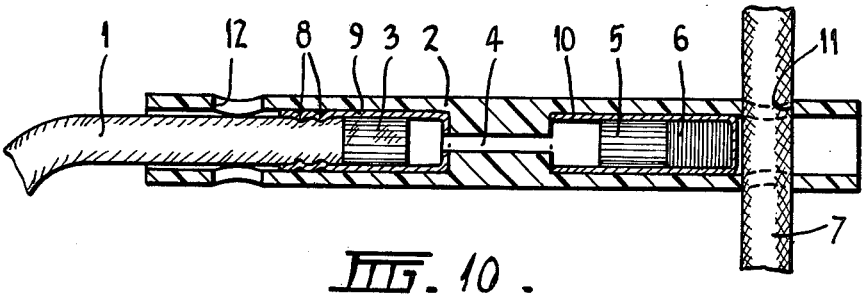

Fuse devices according to one preferred form of the invention have been made according to the diagrammatic representation shown in FIG. 10 which is not to scale in which:

1 represents a length of safety fuse having a burning speed at sea level of 90 to 110 seconds per meter.

2 represents a tubular container comprising a hollow polyethylene cylinder open at both ends and having holes 11 and 12 in its walls.

3 represents an incendiary igniting means in the form of an open ended lead tube (not shown) enclosing an incendiary composition (not shown), one end of said incendiary composition being in contact with the incendiary core (not shown) of the safety fuse 1.

4 represents an air gap in the form of an orifice 2.5 mm in diameter and 10 mm wide in the container 2.

7 represents a length of "Cordtex" detonating cord ("Cordtex" is a registered trade mark) having a detonation velocity of 7000 meters per second which had been inserted through holes 11 at right angles to the axis of the container 2.

9 represents an aluminium tube approximately 5 mm in internal diameter open at one end through which safety fuse 1 was inserted an fixed in contact with the incendiary igniting means 3 by crimping the tube 9 at 8. The closed end of tube 9 had a circular hole in it approximately 3 mm in diameter. The gap between the closed end of tube 9 and the incendiary igniting device was approximately 3 mm.

10 represents an aluminium tube of approximately 5 mm internal diameter open at one end, in said tube 10 there was an explosive composition 6 in contact with the closed end of tube 10 and in contact with what is commonly known as a delay element 5 which acted as the incendiary initiating means. The delay element 5 comprised a multicolored tube with an incendiary composition in the cores.

In some of the devices adhesive was applied through holes 12 to ensure the assembly comprising safety fuse 1 and tube 9 did not slip out of the container 2.

250 of the fuse devices described in this example were connected in series to a common trunk line of "Cordtex" and the trunk line was detonated. No misfire, i.e. when the safety fuse 1 failed to ignite, was observed.

EXAMPLE 2

Figure 11:
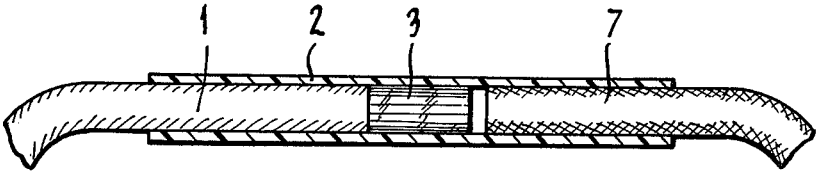

In this comparative example 300 fuse devices illustrated in FIG. 11 were made by locating similar safety fuse 1 to that used in example 1, in a tubular container 2 in contact with an incendiary igniting means 3 similar to that used in example 1, which in turn was located 3 mm from the end of a length of "Cordtex" detonating cord 7 which was used to initiate the device. 4% misfires was observed when devices of this type were tested under similar conditions to those used in example 1.

EXAMPLE 3

The general procedure of example 1 was repeated, except that the fuse devices were immersed in water having a depth of 20 centimeters prior to connection to the "Cordtex" trunk line. 200 of the fuse devices were divided into sets of 10 devices. The first set was immersed for 0.5 hour; the second set for 1 hour, and in a similar manner the residual sets were immersed for periods of time which were increased progressively by 0.5 hour; such that the last set was immersed for 10 hours. No misfire was observed when the trunk line was detonated.

EXAMPLE 4

This comparative example illustrates past commercial practice for igniting safety fuse. Safety fuse similar to that used in Example 1 has been connected to a "bean-hole" connector to form a fuse device which was then connected to commercially available plastic igniter cord having a burning speed of 33 seconds per meter. When such fuse devices are ignited by means of the igniter cord experience has shown that a very low percentage, for example, between 0.1 and 0.2%, of misfires can be expected under dry operating conditions, but that when the operating conditions are wet, as simulated in example 3, the percentage of misfires is liable to be such that the use of such devices is impractical.

I claim:

1. A fuse device for the ignition of incendiary fusecord by a detonation, said device comprising at least one length of incendiary fusecord in a contiguous relationship with an incendiary igniting means capable of igniting the core of said fusecord and comprising an incendiary initating means separated by a gap from the said igniting means, and being capable of being ignited by a detonation whereby burning particulate debris is propelled across said gap onto said igniting means to thereby ignite the latter the part of said fusecord contiguous to said igniting means, the initiating means and the igniting means being located in a tubular container.

2. A fuse device according to claim 1 wherein the incendiary fusecord is an energy conveying device selected from the group consisting of safety fuse, slow igniter cord and fast igniter cord.

3. A fuse device according to claim 1 wherein the incendiary igniting means is a delay element.

4. A fuse device according to claim 1 wherein the incendiary initiating means is a delay element.

5. A fuse device according to claim 1 wherein said gap comprises an orifice of cross-sectional area not greater than the cross sectional area of the said incendiary initiating means.

6. A fuse device according to claim 1 wherein said gap has a width in the range of 10 mm to 30 mm inclusive.

7. A process of sequential firing of a series of explosive charges wherein fuse devices according to claim 1 are used to initiate the explosive charges and the said fuse devices are themselves initiated by detonating devices attached to at least one trunk line in the form of detonating cord.

8. A fuse device comprising: at least one length of incendiary fusecord having an incendiary core along which energy is conveyed by burning of the core; an incendiary igniting means in the form of a mass of incendiary material which when it burns provides an intense hot flame capable of igniting the core of said fusecord, said igniting means being disposed in contiguous relationship with a portion of said fusecord; an incendiary initiating means separated by a gap from said igniting means, said initiating means being capable of being ignited by a detonating device so that upon detonation burning particulate debris is propelled across said gap to ignite said igniting means; and a tubular container surrounding said initiating means, said igniting means and the portion of said fusecord which is contiguous to said igniting means, said tubular container having an opening therein located adjacent said initiating means for receiving a detonating device.

9. An assembly including a fuse device as in claim 8 wherein said tubular container has two aligned openings therein facing transversely to the axis of said tubular container, and including a length of detonating cord extending through said aligned openings.

10. A process of igniting incendiary fusecord by a detonation wherein the said detonation ignites an incendiary initiating means and propels burning particulate debris from said incendiary initiating means across a gap onto an incendiary igniting means which is contiguous with said incendiary fusecord thereby igniting said incendiary igniting means which in turn ignites said incendiary fusecord.

11. A fuse device as in claim 1 or claim 8 in combination with a detonator disposed so as to ignite the incendiary initiating means.

* * * * *